US005456948A

United States Patent [19]

Mathisen et al.

[11] Patent Number: 5,456,948

[45] Date of Patent: Oct. 10, 1995

[54] NONFLAMMABLE LUBRICIOUS COMPOSITION

[75] Inventors: Todd R. Mathisen, Lake Elmo; Scott D. Thomas, Woodbury, both of Minn.

[73] Assignee: Minnesota Mining and Manufacturing Company, St. Paul, Minn.

[21] Appl. No.: 272,011

[22] Filed: Jul. 8, 1994

Related U.S. Application Data

[62] Division of Ser. No. 68,683, May 27, 1993, Pat. No. 5,352, 378.

[51] Int. Cl.[6] ..... B05D 3/02; B05D 5/08; B05D 7/02

[52] U.S. Cl. ..... 427/387; 427/384; 427/2.28

[58] Field of Search ..... 427/2.12, 2.30, 427/2.28, 387, 384

[56] References Cited

U.S. PATENT DOCUMENTS

| | | | |
|---|---|---|---|
| 4,636,407 | 1/1987 | Comper et al. | 427/387 |
| 4,664,657 | 5/1987 | Williamitis et al. | 428/450 |
| 4,675,020 | 6/1987 | McPhee | 604/411 |
| 4,705,709 | 11/1987 | Vailancourt | 427/2.28 |
| 4,713,402 | 12/1987 | Solomon | 427/2.1 |
| 4,806,430 | 2/1989 | Spielvogel et al. | 428/450 |
| 4,838,876 | 6/1989 | Wong et al. | 604/265 |
| 4,844,986 | 7/1989 | Karakelle et al. | 427/2.12 |
| 4,868,015 | 9/1989 | Shishido | 427/286 |
| 4,925,668 | 5/1990 | Kahn et al. | 427/2.3 |
| 4,954,284 | 9/1990 | Batt et al. | 252/170 |
| 4,997,684 | 3/1991 | Franz et al. | 427/387 |
| 5,002,757 | 3/1991 | Gupta | 424/41 |
| 5,061,738 | 10/1991 | Solomon et al. | 523/100 |
| 5,162,381 | 11/1992 | Richard et al. | 521/89 |
| 5,266,359 | 11/1993 | Spielvogel | 427/2.28 |
| 5,338,312 | 8/1994 | Montgomery | 427/2.3 |
| 5,340,614 | 8/1994 | Perman et al. | 427/2.3 |

FOREIGN PATENT DOCUMENTS

| | | |
|---|---|---|
| 0380102A1 | 1/1990 | European Pat. Off. . |
| 0465037A1 | 8/1991 | European Pat. Off. . |
| 0494648A2 | 1/1992 | European Pat. Off. . |

OTHER PUBLICATIONS

"Ozone Treaty Tightened, CFC Substitutes Controlled," Chemical and Engineering News, p. 5, (Dec. 7, 1992).

*Primary Examiner*—Diana Dudash

*Attorney, Agent, or Firm*—Gary L. Griswold; Walter N. Kirn; Robert H. Brink

[57] ABSTRACT

A nonflammable composition that is useful for applying silicone lubricants to the surfaces of medical articles is described. The composition includes a highly fluorinated organic compound, a fluorine-free solvent, and a silicone lubricant.

14 Claims, No Drawings

NONFLAMMABLE LUBRICIOUS COMPOSITION

This is a division of application Ser. No. 08/068,683 filed May 27, 1993, now U.S. Pat. No. 5,352,378.

BACKGROUND OF THE INVENTION

The invention relates to lubricious coating compositions and methods of using said compositions.

Medical articles such as surgical needles, catheters, cannulas, probes, endotracheal tubes, arteriovenous shunts, and thermometers are often inserted into a patient. To minimize discomfort to the patient, the external surface of the instrument typically is coated with a silicone lubricant so that the instrument slides or penetrates more easily into the patient.

The silicone lubricant typically is applied to the external surface of the medical instrument by coating the surface of the instrument with a solvent in which the silicone is dissolved, and allowing the solvent to evaporate. See, for example, the descriptions of silicone lubricants and appropriate solvents for the lubricants in U.S. Pat. Nos. 5,061,738 (Solomon et al.), 4,925,668 (Khan et al.), 4,844,986 (Karakelle et al.), 4,838,876 (Wong et al.), 4,806,430 (Spielvogel et al.), and 4,664,657 (Williamitis et al.), and European Patent Applications 494,648 (Granger et al.), and 380,102 (Hattori et al.), which descriptions are hereby incorporated by reference.

Low boiling organic solvents are preferred for dissolving the silicone lubricant. Solvents which have been used include 1,1,2-trichloro-1,2,2-trifluoroethane, Freon™ solvents, and heptane.

The use of chlorofluorocarbons (CFCs) is coming under increasing attack and regulation. See, e.g., "Ozone Treaty Tightened, CFC Substitutes Controlled," Chemical and Engineering News, p.5, (Dec. 7, 1992).

European Patent Application 465,037 (Adenaert et al.) describes solvent compositions which include (a) a fluorine-free organic liquid, (b) a perfluorinated organic liquid, and (c) a co-solvent which is miscible with components (a) and (b). These compositions are said to have low ozone depletion potentials.

SUMMARY OF THE INVENTION

Briefly, in one aspect, the present invention provides a nonflammable liquid composition, useful for applying a silicone lubricant to medical articles, comprising (a) a nonflammable, highly fluorinated organic compound, (b) a silicone lubricant, and (c) a fluorine-free solvent in which said silicone lubricant is soluble. Said highly fluorinated organic compound is sufficiently soluble in said fluorine-free solvent to render said fluorine-free solvent nonflammable.

In another aspect, the present invention provides a method of preparing coated articles comprising coating said article with the composition of this invention.

"Highly fluorinated organic compound", as used herein, is an organic molecule in which a sufficient number of the hydrogen atom bonding sites on the molecule have been replaced by fluorine atoms to render the molecule nonflammable. Preferably, the highly fluorinated organic compound comprises from 40% to 83% by weight fluorine, more preferably from 50% to 83% by weight fluorine. Preferably, the highly fluorinated organic compound has a boiling point lower than the boiling point of the fluorine-free solvent.

"Nonflammable", as used herein means that the composition, when tested in Stetaflash™ Closed-Cup Apparatus according to ASTM D-3278-82, does not exhibit a flash point in the cup.

Other features and advantages of the invention will be apparent from the description of the preferred embodiments thereof, and from the claims.

DESCRIPTION OF THE PREFERRED EMBODIMENTS

The highly fluorinated organic compound can be branched or unbranched, cyclic or acyclic, and preferably comprises from 2 to 8 carbon atoms, more preferably from 5 to 8 carbon atoms. The preferred highly fluorinated organic compounds have boiling points of from −50° C. to 100° C., more preferably from 25° C. to 100° C.

The highly fluorinated organic compound is preferably a hydrochlorofluorocarbon (hereinafter referred to as HCFC), hydrofluorocarbon (hereinafter referred to as HFC), or a chlorine-free, perfluorinated compound (herein referred to as PFC). "Perfluorinated" as used in this application means that essentially all hydrogen atoms have been replaced with fluorine atoms.

The HCFCs, HFCs, and PFCs useful in the mixtures of the present invention are odorless, nontoxic, noncorrosive, and are nonflammable. They are low boiling, typically boiling in the range of −50° to 175° C., preferably in the range of −50° to 100° C.

The HCFCs have the general formula $C_aCl_bH_cF_d$ wherein a=2 to 8, b=1 to 16, c=1 to 16, d=1 to 16. Specific examples of suitable HCFCs useful in practicing the present invention include, among others, $CF_3ChCl_2$, $CF_3CF_2ChCl_2$, $ClCF_2CF_2CFClH$, and $CCl_2FCH_3$.

The HFCs have the general formula $C_aH_bF_cO_d$ wherein a=2 to 8, b=1 to 17, c=1 to 17, d=0 to 4. Specific examples of suitable HFCs useful in practicing the present invention include, among others, 1,4-dihydro-perfluorobutane, 2,3-dihydro-perfluoropentane, and 2-hydro-3-oxa-perfluoroheptane.

The PFCs are generally perfluoroaliphatic or perfluorocycloaliphatic, and have 2 to 8 carbon atoms, preferably 4 to 8 carbon atoms, and may contain heteroatoms, such as divalent oxygen, trivalent nitrogen, or polyvalent sulfur. Specific examples of suitable PFCs useful in practicing the present invention include, among others, perfluoroalkanes, such as perfluorobutane, perfluoropentane, perfluorohexane, perfluoroheptane, and perfluorooctane; perfluorocycloalkanes, such as perfluorocyclobutane, perfluorodimethylcyclobutane, and perfluoromethylcyclopentane; perfluoroethers, such as perfluoro-2-butyl-tetrahydrofuran; formals, such as perfluoro-3,5-dioxaheptane; perfluoroamines, such as perfluorotriethylamine, perfluorotripropylamine, and perfluorotributylamine; perfluoroaminoethers, such as perfluoro-N-methyl morpholine; and perfluorinated sulfur compounds.

The fluorine-free solvent should be capable of dissolving the silicone lubricant. The fluorine-free solvent also preferably has a boiling point that is higher than the boiling point of the highly fluorinated organic compound. If the boiling point difference between the highly fluorinated organic compound and the fluorine-free solvent is too small, the composition may be flammable. For example, in the case of PFCs, the most preferred compositions are those in which the fluorine-free solvent has a boiling point that is at least about 38° C. higher than the boiling point of the highly fluorinated organic compound. Preferred fluorine-free solvents have a boiling point of from 25° C. to 150° C. Examples of fluorine-free solvents useful in practicing the present invention include hydrocarbons, such as n-hexane, n-heptane, n-octane, and isooctane; ethers, such as isopropyl ether; alcohols, such as isopropanol and t-butanol; and siloxanes such as hexamethyldisiloxane.

Silicone lubricants useful in practicing the present invention are known and are commercially available. Preferred lubricants are stable, noncuring, high purity, medical grade silicones such as the polydialkylsiloxanes of formula I.

I

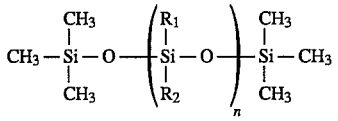

In formula I, $R_1$ and $R_2$ may be independently an alkyl group of from 1 to 20 carbon atoms, or taken together may form a ring of from 4 to 8 carbon atoms. The number of repeating units, n, is sufficient to provide a viscosity of from about 20 to 1,000,000 centistokes. In particularly preferred polydialkylsiloxanes of formula I, $R_1$ is methyl and the viscosity is from about 1,000 to 60,000 centistokes. The most preferred silicones are polydimethylsiloxanes having a viscosity of from about 5,000 to 20,000 as exemplified by the commercially available product Dow Corning™ 360 Medical Fluid available from Dow Corning, Midland, Mich.

The compositions of this invention comprise a sufficient quantity of the highly fluorinated organic compound dissolved in the fluorine-free solvent to render the composition nonflammable, and a sufficient quantity of the fluorine-free solvent to dissolve the silicone lubricant in the composition. The preferred composition includes a sufficient quantity of the silicone to adequately lubricate the surface of an article after the highly fluorinated organic compound and the fluorine-free solvent evaporate. Preferably the composition comprises from 10% to 50% by volume of the highly fluorinated organic compound, from 50% to 80% by volume of the fluorine-free solvent, and from 1% to 30% by volume of the silicone lubricant.

Some of the preferred compositions include two layers: a first layer comprising the highly fluorinated organic compound, the fluorine-free solvent, and the silicone lubricant; and a second layer, consisting primarily, i.e. greater than 50% by volume, of the highly fluorinated organic compound. An advantage of the two layer composition is that as the highly fluorinated organic compound evaporates from the first layer, it is replenished by additional highly fluorinated organic compound passing from the second layer to the first layer. Thus, the second layer provides a reservoir of highly fluorinated organic compound.

Application of the composition of this invention to a substrate may be carried out by any conventional technique. For example, the composition may be brushed or sprayed (e.g., as an aerosol) onto the substrate. The preferred method of application is merely to immerse the substrate into the composition. If the substrate is a tubing, such as a catheter, and it is desired to ensure that the composition coats the lumen wall, it may be advantageous to draw the composition into the lumen by the application of reduced pressure.

Immersion of the substrate in the composition may be carried out at any suitable temperature and may be maintained for any convenient length of time. The time and temperature of contact are not critical, but preferably are about 1 second to 1 hour at ambient temperature.

After withdrawing the substrate from the composition the highly fluorinated organic compound and the fluorine-free solvent may be removed by evaporation. If desired, the rate of evaporation may be accelerated by application of reduced pressure or mild heat. The coating of the composition applied to the substrate may be of any convenient thickness, and in practice, the thickness will be determined by such factors as the viscosity of the silicone, the temperature of the application, and the rate of withdrawal. For most substrates, the lubricant preferably is applied as thinly as practical, since no significant advantage is gained by thicker coatings.

The preferred compositions can be used to coat the surfaces of a wide variety of medical articles, including surgical needles, catheters, endotracheal tubes, shunts, probes, thermometers, cannulas, and the like.

EXAMPLES

Various combinations of highly fluorinated organic compounds and fluorine-free solvents were prepared and tested for flammability. Which compositions were nonflammable was determined using the procedure described in ASTM D-3278-82. If a composition exhibited a flash point in the cup, when tested according to this procedure, it was deemed to be flammable. The results are shown in Table 1–3.

Examples of nonflammable mixtures of highly fluorinated organic compound and fluorine-free solvent are shown in Table 1. Nonflammable means that no flash was observed by the ASTM test method D 3278-82 or D 56 at or below the boiling point of the solvent or 100° F. whichever is smaller (this is the DOT, ANSI, and NFPA definition).

TABLE 1

| Highly fluorinated organic, volume % | Fluorine-free Solvent, volume % |
|---|---|
| perfluoropentane, 10% | n-heptane, 90% |
| perfluoropentane, 15% | n-heptane, 85% |
| perfluoropentane, 20% | n-heptane, 80% |
| perfluoropentane, 25% | n-heptane, 75% |
| perfluoropentane, 50% | isopropyl ether, 50% |
| perfluoropentane, 50% | n-hexane, 50% |
| perfluoroheptane, 6% | n-octane, 94% |
| perfluoro-N-methyl-morpholine, 22% | n-heptane, 78% |
| perfluorodimethyl-cyclobutane, 28% | n-heptane, 72% |
| perfluorohexane, 6% | n-octane, 94% |
| perfluorodimethyl-cyclobutane, 12% | n-octane, 88% |
| perfluoropentane, 50% | iso-octane, 50% |
| perfluorpentane, 50% | hexmethyldisiloxane, 50% |
| 1,1-dichloro-1-fluoro-ethane, 50% | n-heptane, 50% |

The mixtures in Table 2 exhibited no flash in the cup but did support a flame above the cup. This is technically not a flash, and therefore these mixtures are nonflammable by the definition. However, these compositions may have a greater fire hazard associated with them than those compositions listed in Table 1.

TABLE 2

| Highly fluorinated organic, volume % | Fluorine-Free Solvent, Volume % |
|---|---|
| perfluoropentane, 11% | n-octane, 89% |
| perfluoro-N-methyl-morpholine, 4% | n-octane, 86% |
| perfluoro-dimethyl- | n-hexane, 50% |

TABLE 2-continued

| Highly fluorinated organic, volume % | Fluorine-Free Solvent, Volume % |
|---|---|
| cyclobutane, 50% | |
| perfluorohexane, 9% | n-heptane, 91% |
| 2-hydro-3-oxa-perfluoroheptane, 9% | n-octane, 91% |

The mixtures in Table 3 are a list of flammable solvent blends which did exhibit a flash in the cup.

TABLE 3

| Highly Fluorinated Organic, Volume % | Fluorine-Free Solvent, Volume % |
|---|---|
| perfluoropentane, 5% | n-heptane, 95% |
| perfluoro-N-methyl-morpholine, 50% | n-hexane, 50% |
| 1,1-dichloro-1-fluoro-ethane, 50% | n-hexane, 50% |
| 1,1-dichloro-1-fluoro-ethane, 50% | iso-propyl ether, 50% |
| perfluorohexane, 25% | n-hexane, 75% |

Note that the definition for a flammable liquid by DOT, ANSI, and NFPA is a flash point below 100° F.; however, the ASTM D3278-82 test method for flash point includes the following disclaimer: "This standard should be used to measure and describe the properties of materials, products, or assemblies in response to heat and flame under controlled laboratory condition and should not be used to describe or appraise the fire hazard or fire risk of materials, products, or assemblies under actual fire conditions. However, results of this test may be used as elements of a fire risk assessments which takes into account all of the factors which are pertinent to an assessment of the fire hazard of a particular end use."

The solubility of a silicone lubricant in a mixture of highly fluorinated organic compound and fluorine-free solvent, was determined by adding the lubricant to the mixture, agitating the mixture, and observing whether the lubricant is miscible. For example, Dow Corning™ 360 Medical Fluid was miscible in amounts up to at least 25%, by volume, in a mixture of 20% by volume perfluoropentane and 80% by volume n-heptane. When 20% and 25% by volume Dow Corning™ 360 Medical Fluid was included in the composition, the composition was hazy.

Hypodermic needles in general may be lubricated by immersing at least two-thirds, by length, of a needle for 5 seconds into a composition, removing the needle from the composition, keeping the needle tip pointed down, and allowing the needle to air dry. Alternatively, needles can be lubricated by following the procedures described in Spielvogel et al., U.S. Pat. No. 4,806,430 (col. 8, first full paragraph), which description is hereby incorporated by reference.

Example 1

Fifty hypodermic needles (16 gauge) were lubricated according to the Spielvogel et al. procedure using a coating composition consisting of 5% by volume Dow Corning™ 360 Medical Fluid, 76% by volume heptane, and 19% by volume perfluoropentane. The coated needles were tested for penetration using a rubber membrane following the procedure described in Karakelle et al., U.S. Pat. No. 4,844,986, which description is hereby incorporated by reference. The needles provided a mean penetration force of 4.4N.

Comparative Example C1

Fifty needles were coated and tested as in Example 1 except with a coating composition of 5% by volume Dow Corning™ 360 Medical Fluid DC in Freon™ 113 solvent. The needles coated with the Freon™ 113 solvent had a mean penetration force of 4.8N.

Comparative Example C3

Fifty needles were tested as in Example 1 except without coating. The uncoated needles had a mean penetration of 5.3N.

All mean penetration forces in Example 1 and Comparative Examples C1 and C2 had a standard deviation of 0.4N.

Connectors are often used to provide access to a medical fluid in a sealed container. Connectors are described, for example in U.S. Pat. No. 4,675,020 (McPhee) which description is hereby incorporated by reference.

Example 2

A connector, commercially available as ADD-A-VIAL™ connector from Kendall McGaw Laboratories, Inc. of Irvine, Calif., was immersed in the composition of Example 1. The connector was removed from the composition and air dried. The force required for the connector to pierce the septum of a medical ampule was measured by securing the connector to the jaws of an Instron™ testing machine, alligning the connector with the septum, and setting the Instron™ testing machine to push the connector into the septum at a crosshead speed of 0.08 cm/s. Twenty-five samples were run, and exhibited a mean penetration force of 39.5±8.4N.

Comparative Example C3

Connectors were lubricated and tested as in Example 2 except using the coating solution of Comparative Example C1 and exhibited a mean penetration force of 47.1±8.9N.

Comparative Example C4

An uncoated connector was tested as in Example 2 and was unable to pierce the rubber septum.

I.V. bag shunts are often used to puncture I.V. bags to add medication to the I.V. solution. Once the I.V. shunt punctures the I.V. bag, the bottle or bag containing the medication is attached to the other end of the shunt.

Example 3

I.V. shunts purchased from McGaw Industries were immersed (to one-third the way up the shunt) in the composition of Example 1. The shunt was then removed from the composition and the section that was immersed was blotted with a lint free cloth to remove excess solution. After blotting, the shunt was placed in a protective cover and allowed to dry to provide the lubricated shunt.

Example 4

Lubricating the anterior surface of a catheter was conducted by forcing the coating composition of Example 1 through a suspended catheter. The excess coating composition was allowed to drip onto a cloth, and the catheter remained suspended until the solvents evaporated.

What is claimed is:

1. A method of applying a silicone lubricant to a surface of an article, comprising the steps of (a) coating a surface of said article with a nonflammable liquid composition comprising a silicone lubricant; a fluorine-free solvent in which said silicone lubricant is soluble; and a highly fluorinated organic compound selected from the group consisting of hydrochlorofluorocarbons, hydrofluorocarbons and chlorine-free perfluorocarbons; wherein said liquid composition comprises an amount of said highly fluorinated organic compound sufficient to render the composition nonflammable; and (b) evaporating said highly fluorinated organic compound and said fluorine-free solvent.

2. The method of claim 1, wherein said highly fluorinated organic compound has a boiling point of from −50° C. to 100° C.

3. The method of claim 1, wherein said highly fluorinated organic compound contains from 40% to 83% by weight fluorine.

4. The method of claim 1, wherein said highly fluorinated organic compound contains from 2 to 8 carbon atoms.

5. The method of claim 1, wherein said highly fluorinated organic compound contains from 5 to 8 carbon atoms.

6. The method of claim 1, wherein said highly fluorinated organic compound is perfluorinated.

7. The method of claim 1, wherein said highly fluorinated organic compound is selected from the group consisting of perfluoropentane, perfluorohexane, perfluoroheptane, perfluoro-N-methylmorpholine, and perfluoro-dimethylcyclobutane.

8. The method of claim 1, wherein said fluorine-free solvent has a boiling point of from 25° C. to 150° C.

9. The method of claim 1, wherein said fluorine-free solvent is an alkane.

10. The method of claim 1, wherein said fluorine-free solvent is selected from the group consisting of n-hexane, n-heptane, n-octane, n-nonane, t-butanol, hexamethyldisiloxane, and isopropylether.

11. The method of claim 1, wherein the boiling point of said fluorine-free solvent is at least 38° C. higher than the boiling point of said highly fluorinated organic.

12. The method of claim 1, wherein said silicone lubricant is a polydialkylsiloxane.

13. The method of claim 1, wherein said composition comprises from 10% to 50% by volume of said highly fluorinated organic compound, from 50% to 80% by volume of said fluorine-free solvent, and from 1% to 30% by volume of said silicone lubricant.

14. The method of claim 1, wherein there is a sufficient amount of said highly fluorinated organic compound in said liquid composition such that said liquid composition comprises two layers; a first layer comprising said highly fluorinated organic compound, said silicone lubricant, and said fluorine-free solvent; and a second layer consisting essentially of said highly fluorinated organic compound.

* * * * *

UNITED STATES PATENT AND TRADEMARK OFFICE

CERTIFICATE OF CORRECTION

PATENT NO.: 5,456,948

DATED: October 10, 1995

INVENTOR(S): Todd R. Mathisen and Scott D. Thomas

It is certified that error appears in the above-identified patent and that said Letters Patent is hereby corrected as shown below:

Column 3, line 4, after "isooctane" insert --, n-nonane--.

Signed and Sealed this

Twenty-third Day of April, 1996

*Attest:*

Bruce Lehman

BRUCE LEHMAN

*Attesting Officer*

*Commissioner of Patents and Trademarks*